US007178487B2

(12) United States Patent
Zahner et al.

(10) Patent No.: US 7,178,487 B2
(45) Date of Patent: Feb. 20, 2007

(54) COMBUSTION-ENGINED SETTING TOOL

(75) Inventors: Mario Zahner, Chur (CH); Stefan Petkov, Buchs (CH); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/220,749

(22) Filed: Sep. 6, 2005

(65) Prior Publication Data

US 2006/0048727 A1 Mar. 9, 2006

(30) Foreign Application Priority Data

Sep. 6, 2004 (DE) ..... 10 2004 042 953

(51) Int. Cl.
*F02B 71/00* (2006.01)

(52) U.S. Cl. ..... 123/46 H; 173/209; 227/9

(58) Field of Classification Search ..... 123/27 R, 123/46 H, 46 SC; 173/162.1, 209; 227/9
See application file for complete search history.

(56) References Cited

U.S. PATENT DOCUMENTS 4,825,819 A * 5/1989 Morash ..... 123/46 R
5,181,495 A 1/1993 Gschwend et al.
6,463,894 B2 * 10/2002 Hasler et al. ..... 123/46 R
6,532,917 B2 * 3/2003 Thieleke et al. ..... 123/46 SC
6,755,335 B2 * 6/2004 Fielitz ..... 227/10
6,968,811 B2 * 11/2005 Rosenbaum ..... 123/41.2
2003/0097832 A1 * 5/2003 Voelker et al. ..... 60/39.6
2006/0075978 A1 * 4/2006 Schiestl et al. ..... 123/46 H

* cited by examiner

*Primary Examiner*—Stephen K. Cronin
*Assistant Examiner*—Ka Chun Leung
(74) *Attorney, Agent, or Firm*—Abelman, Frayne & Schwab

(57) ABSTRACT

A combustion-engined setting tool for driving fastening elements in constructional components includes a combustion chamber (14) for combusting therein a full gas-oxidant mixture, at least one guide element (20) arranged coaxially with a longitudinal axis (34) of the combustion chamber (14) for supporting axially displaceable wall (17) of the combustion chamber (14) for an axial displacement along the guide element (20) which is pivotally supported in a drag bearing (22), and a guide cylinder (12) adjoining the combustion chamber (14) in which a setting piston (11) is arranged for an axial displacement therein.

7 Claims, 3 Drawing Sheets

COMBUSTION-ENGINED SETTING TOOL

BACKGROUND OF THE INVENTION

1. Field of the Invention

The present invention relates to a combustion-engined setting tool for driving fastening elements such as nails, bolts, pins, and the like in a constructional component and including a combustion chamber for combusting therein a fuel gas-oxidant mixture and having an axially displaceable wall, a guide cylinder adjoining the combustion chamber, and a setting piston displaceably arranged in the guide cylinder.

2. Description of the Prior Art

Setting tools of the type described above can be driven by gaseous fuels or liquid fuels which are evaporated before combustion. The setting energy for driving in a fastening element is obtained by combustion of a fuel-air mixture in a combustion chamber and is transmitted to the fastening element by the setting piston.

German patent DE 40 32 202 C2, from which the present invention proceeds discloses a setting tool of the type described above and in which a guide cylinder for a setting piston is at least partially displaceable in a combustion chamber casing. The combustion space of the combustion chamber is divided in at least two chambers. The two chambers are separated from each other by at least one displaceable intermediate wall or separation plate and are limited by a second, displaceable rear wall. For removal of flue gases from the combustion chamber, the second and intermediate walls are displaced toward a combustion chamber wall adjacent to the setting piston, with a very small remaining space, whereby the flue gas is forced out of the combustion chamber. When the chambers are expanded again, upon the setting tool being pressed again against a constructional component, the chambers and, thereby, the combustion space are again filled with fresh air. The walls are displaced by several, displaceable relative to the combustion chamber, guide rods.

The drawbacks of the known setting tool consists in that the use of several guide rods for displacing the displaceable walls is associated with large expenses and, on the other hand, can lead to jamming of the displaceable mechanism when the clearances are not precisely formed at the elements of the displaceable mechanism are produced with an inadequate precision.

Accordingly, an object of the present invention is to produce a setting tool of the type described above in which the foregoing drawbacks of the known setting tool are eliminated.

SUMMARY OF THE INVENTION

This and other objects of the present invention, which will become apparent hereinafter, are achieved by providing a setting tool having at least one guide element arranged coaxially with a longitudinal axis of the combustion chamber for supporting the axially displaceable wall for an axial displacement therealong and pivotally supported in a drag bearing.

The pivotal arrangement of the guide element prevents the movable relative to each other, functional components such as, e.g., an axially displaceable, relative to the combustion chamber, wall from jamming. Also, when additionally, the combustion chamber casing is axially displaceable, in particular relative to the guide cylinder, the limited pivotal movement of the axially extending guide element insures a good displaceability of the axially displaceable components. With a limited pivotal movement of the guide element, the manufacturing precision can meet less stringent requirements.

Advantageously, the drag bearing is so formed that a maximal pivotal angle $\alpha$ amounts to no more than 10°. This range of the pivot or tilting angle insures an adequate movement between the movable components.

According to a constructively advantageous embodiment of the present invention, the guide element is centrally supported in an end wall of the combustion chamber. This substantially insures a friction-free movement even when the combustion chamber casting is tilted, as the tilting takes place about the plane defined by the end wall.

According to a further advantageous embodiment of the present invention, the end wall, together with the support point for the guide element is provided at an end of the guide cylinder adjacent to the combustion chamber. The end wall can, e.g., be formed by the front wall of the combustion chamber, which is provided with openings and which is adjoined by the displaceable wall in a collapsed condition of the combustion chamber. The displaceable wall can be formed, e.g., as a rear wall plate of the combustion chamber and/or as a turbulence-producing plate.

It is beneficial when the drag bearing has an elastic element which supports the support surface of the guide element. With such an element, a certain damping or stiffness at the support point is achieved, as it prevents "chatter" of the guide element at the support point.

It is further advantageous when the guide element is formed as a cylindrical guide bar. The guide bar can be formed as a solid, semi-solid, and hollow body. Such guide bar requires little constructional space and insures good guiding characteristics.

It is also advantageous when the combustion chamber casing is also supported for a limited pivotal movement. This insures a substantial by friction-free movement of displaceable components because the combustion chamber casing is also assigned a guide function for the displaceable wall and it in itself can be axially displaced relative to the guide cylinder and, thus, relative to the front wall of the combustion chamber.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
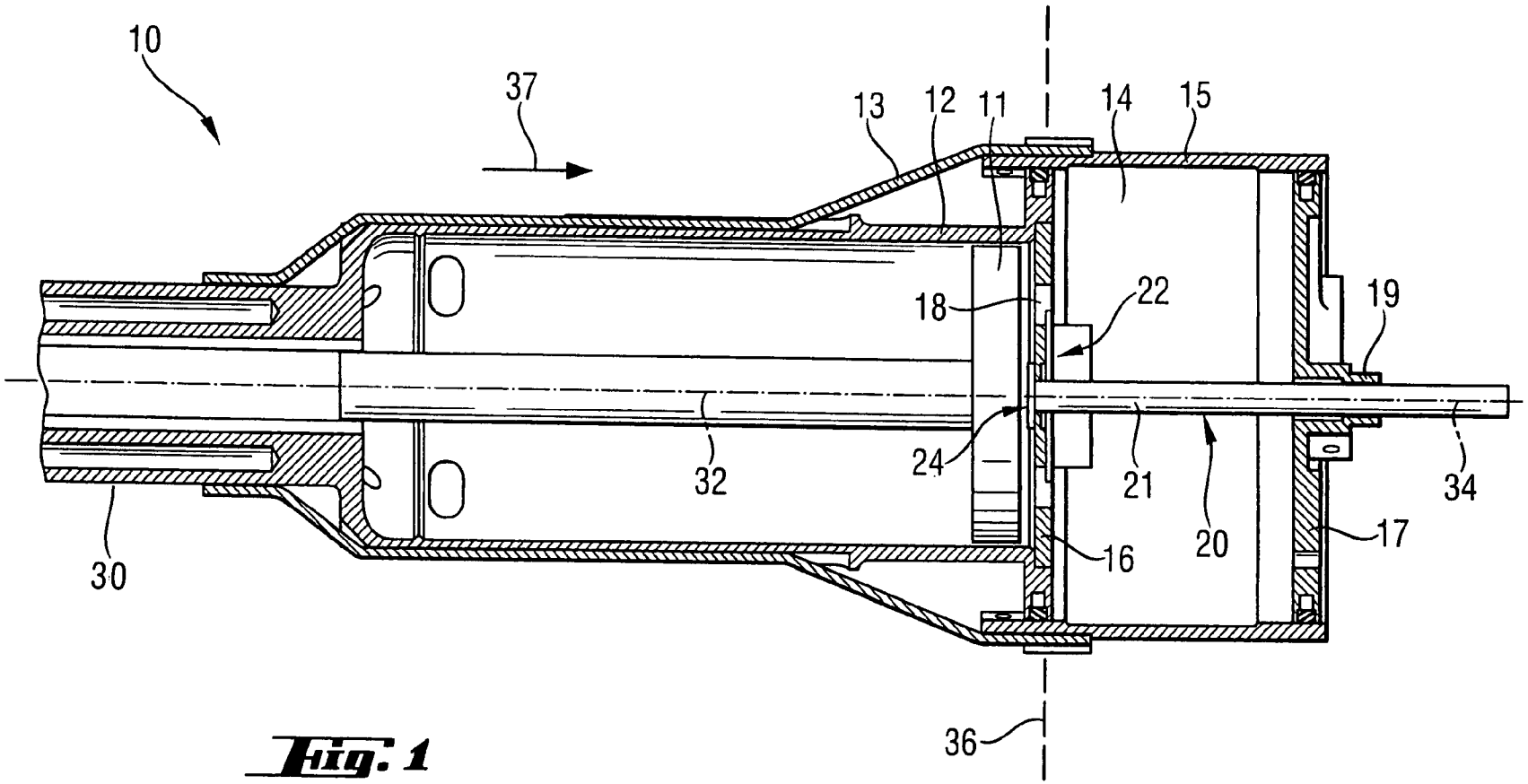
FIG. 1 a longitudinal cross-sectional view of a setting tool according the the present invention with an expanded combustion chamber.
Figure 2:
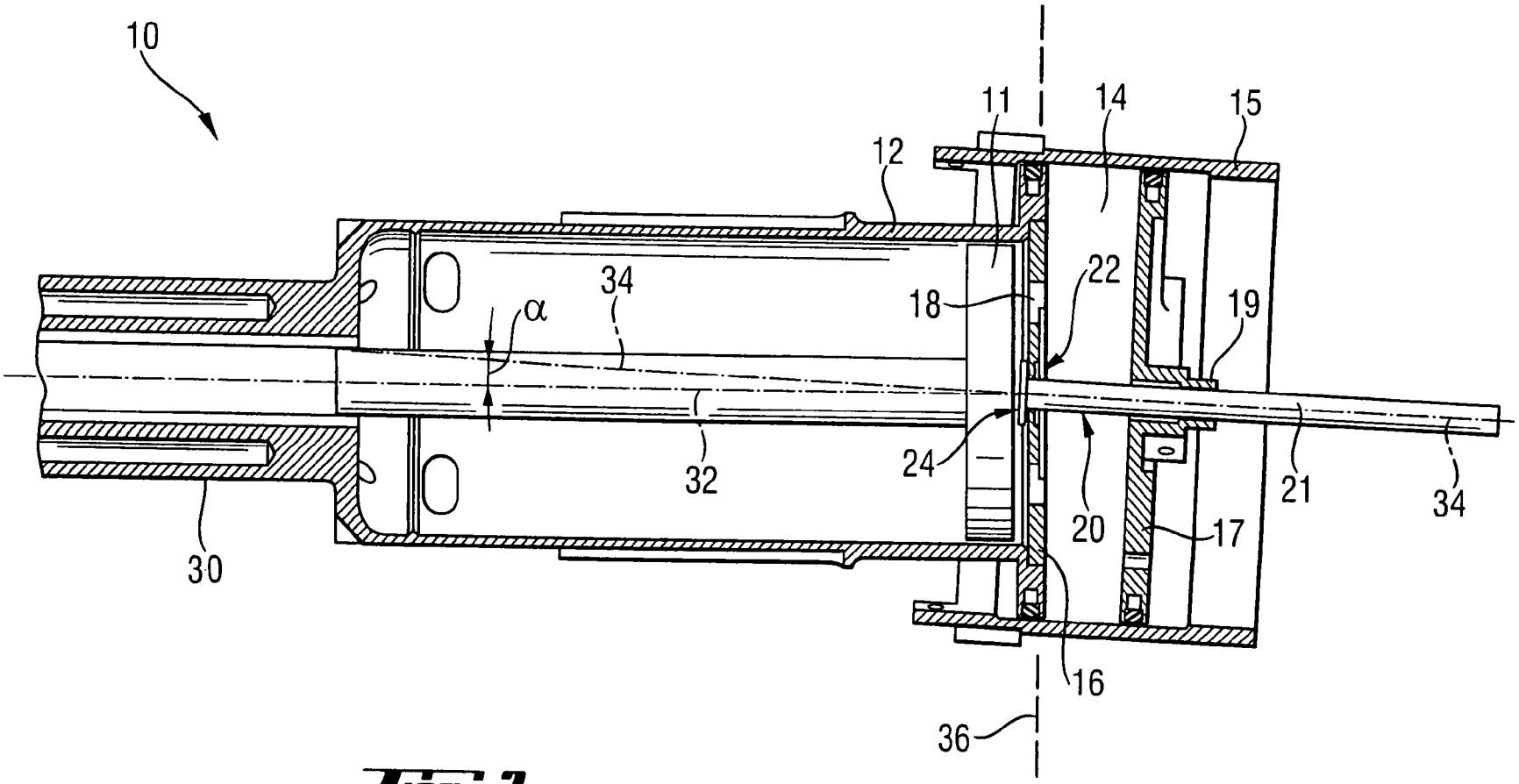
FIG. 2 a longitudinal cross-sectional view of the setting tool shown in FIG. 1 showing an expanding movement of the combustion chamber.
Figure 3:
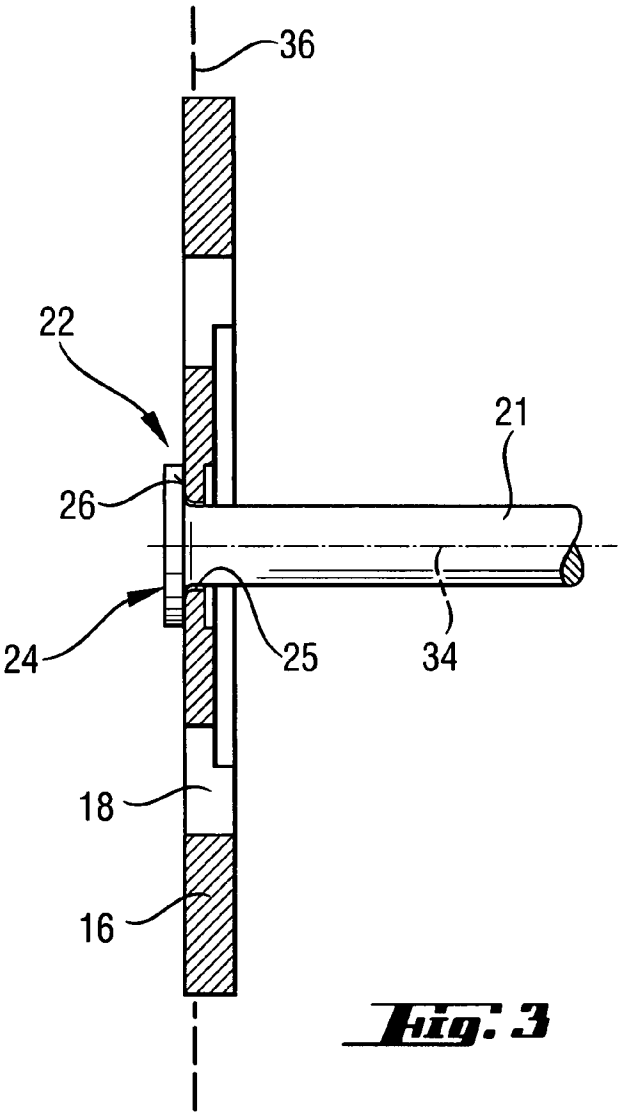
FIG. 3. a cross-sectional view showing a detail of the setting tool according to the present invention.

A combustion-engined setting tool 10 according to the present invention, which is shown in FIGS. 1–3, is driven by a fuel gas that is stored in a fuel reservoir, not shown in the form of a liquefied gas. Instead of the fuel gas, a vaporizable fuel such as, e.g., alcohol or benzene can be used. The setting tool 10 includes a setting mechanism with which a fastening element, not shown, is driven in a constructional component likewise not shown, when the setting tool is pressed against the constructional component and is actuated. The setting mechanism includes, among others, a combustion chamber 14, a guide cylinder 12 that adjoins the combustion chamber 14 and in which an axially displaceable setting piston 11 is arranged, and a bolt guide 30 that adjoins the guide cylinder 12 at the end of the guide cylinder 12 remote from the combustion chamber 14. The bolt guide 30 serves for guiding a fastening element as the fastening element is driven in a constructional component. Fastening elements can be stored, e.g., in a magazine, not shown, secured on the setting tool 10.

The combustion chamber 14 extends, in its expanded condition, shown in FIG. 1, within a combustion chamber casing 15 which is formed in the embodiment shown in FIGS. 1–2 as a substantially cylindrical body. The combustion chamber 14 is limited in a direction of its longitudinal axis 34 by an end wall 16 and an axially displaceable wall 17 that forms the combustion chamber rear wall. The end wall 16, which is formed as a plate with openings 18, is fixedly secured to the end of the guide cylinder 12.

The displaceable wall 17 is displaceably supported with a guide sleeve 19 on a guide element 20 which is formed as a guide bar 21. In the position of the setting 10 shown in FIG. 1 in which the combustion chamber 14 is completely expanded, the displaceable wall 17 is locked in its position, and the combustion chamber 14 is ready for a setting process. The combustion chamber 14 is filled with a fuel-air mixture ignitable with an ignition device, not shown. For actuation of the ignition device, there is provided an actuation or a trigger switch.

The guide bar 21 has a bearing section 24 that is pivotally supported in a drag bearing 22 provided in the end wall 16. The guide bar 21 is secured in the drag bearing 22 both axially and radially. The drag bearing 22 is formed by a central opening 25 provided in the end wall 16 and surrounded by a support surface 26. The drag bearing 22 provides, in cooperation with the bearing section 24 of the guide bar 21, for tilting or pivoting of the guide bar 21 relative to the longitudinal axis 32, which is defined by the guide cylinder 12, by a pivot angle $\alpha$ from 0° to about 10°.

The drag bearing 22 is located in the intersection point of a plane 36, which is defined by the end wall 16, with the longitudinal axis 34 of the combustion chamber 14. The combustion chamber casing 15, which is also displaceable relative to guide cylinder 12 and which also provides a guidance function for the displaceable wall 17, is itself pivotable, within certain limits, about the end wall 16.

When the setting tool 10 is pressed against a constructional component (not shown), the combustion chamber casing 15 is displaced by a rearwardly movable member 13, e.g., a press-on rod or a press-on stirrup in the direction of arrow 37 shown in FIG. 1. The displaceable wall 17 is displaced in the direction of arrow 37 in the combustion chamber casing 15 by a displacing mechanism, not shown.

The pivotal support of the guide bar 21 in the end wall 16 of the combustion chamber 14 prevents jamming of the displaceable wall 17 upon its displacement in the combustion chamber casing 15 when because of manufacturing conditions, the bearing location (or the drag bearing 22) of the guide bar 21 is provided in the end wall 16 not on the longitudinal axis 34 of the combustion chamber 14 or the combustion chamber casing 15. The pivotal arrangement of the combustion chamber casing 15 also prevents jamming of the combustion chamber casing 15 during its displacement.

FIG. 2 shows a pivotal arrangement of the guide bar 21 and of the combustion chamber casing 15. Because of manufacturing tolerances, the longitudinal axis 32 does not coincides with the longitudinal axis 34 or with the displacement axis of the combustion chamber 14 or the combustion chamber casing 15. Upon displacement of the wall 17 and the combustion chamber casing 15 in order to expand the combustion chamber 14, no jamming of the wall 17 or the combustion chamber casing 15 takes place as both can pivot parallel to each other and relative to the longitudinal axis 32 of the guide cylinder 12 by maximum an angle $\alpha$. The pivotal movement of the wall 17 and the combustion chamber casing 15 compensates the manufacturing tolerances. The coaxility of the longitudinal axis 34 and the guide bar 21 is retained.

Figure 4:
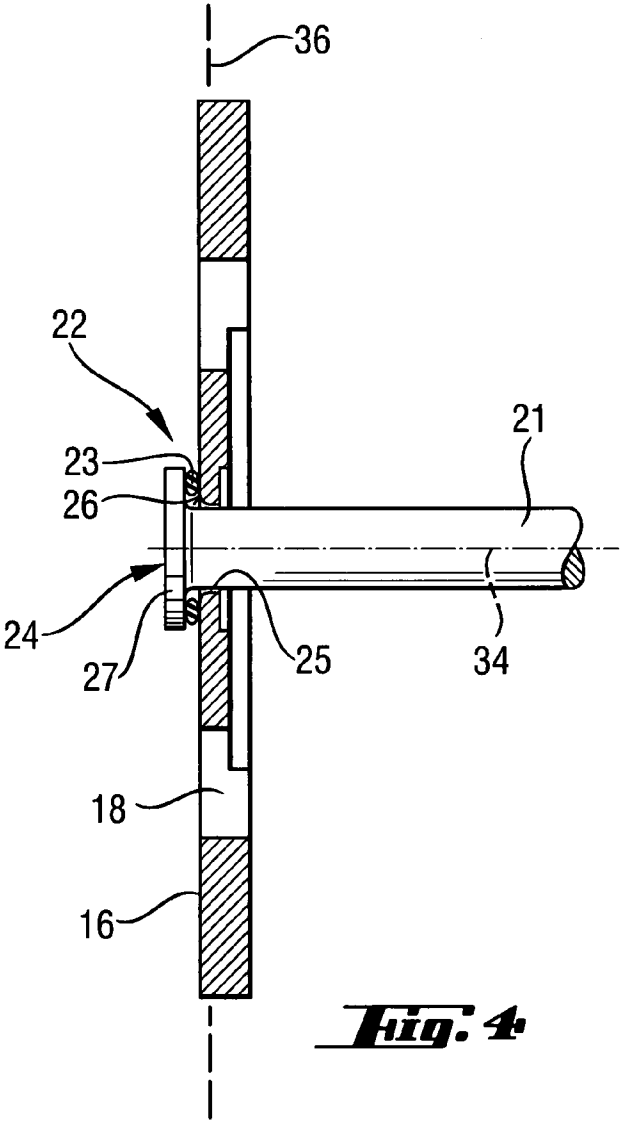
FIG. 4 a cross-sectional view of a detail similar to that shown in FIG. 3 of an inventive setting tool according to another embodiment.

A setting tool, a detail of which is shown in FIG. 4, differs from the setting tool 10 shown in FIGS. 1–3, in that an elastic element 23 such as, e.g., an O-ring formed of rubber, is provided on the drag bearing 22 and which can be engaged regionwise by the bearing section 24 of the guide bar 21. To this end, the bearing section 24 is provided with a flange-shaped shoulder 27. The elastic element 23 damps the pivotal or tilting movement of the guide bar 21 relative to the end wall 16. Likewise, the elastic element 23 reduces or even prevents generation of noise in the drag bearing 22.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool for driving fastening elements in constructional components, comprising:

a combustion chamber (14) for combusting therein a fuel gas-oxidant mixture and having an axially displaceable wall (17);

at least one guide element (20) arranged coaxially with a longitudinal axis (34) of the combustion chamber (14) for supporting the axially displaceable wall (17) for an axial displacement therealong and pivotally supported in a drag bearing (22);

a guide cylinder (12) adjoining the combustion chamber (14); and a setting piston (11) displaceably arranged in the guide cylinder (12).

2. A combustion-engined setting tool according to claim 1, wherein the drag bearing (22) is formed for providing a maximal pivot angle $\alpha$ of the at least one guide element of no more than 10°.

3. A combustion-engined setting tool according to claim 1, wherein the combustion chamber (14) has an end wall (16), and wherein at least one drag guide element (20) is supported centrally in the end wall (16).

4. A combustion-engined setting tool according to claim 3, wherein the end wall (16) adjoins an end of the guide cylinder (12) adjacent to the combustion chamber (14).

5. A combustion-engined setting tool according to claim 1, wherein the drag bearing (22) comprises an elastic element (23) for supporting a bearing section (24) of the guide element.

6. A combustion-engined setting tool according to claim 1, wherein the at least one guide element (20) is formed as a cylindrical guide bar (21).

7. A combustion-engined setting tool according to claim 1, further comprising a pivotally supported combustion chamber casing (15) for the axially expanding combustion chamber (14).

* * * * *